US011192140B2

(12) United States Patent
Ono et al.

(10) Patent No.: US 11,192,140 B2
(45) Date of Patent: Dec. 7, 2021

(54) TRANSDUCER AND TRANSDUCER ARRAY

(71) Applicant: Kabushiki Kaisha Toshiba, Minato-ku (JP)

(72) Inventors: Tomio Ono, Yokohama (JP); Kazuhiro Itsumi, Koto (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 936 days.

(21) Appl. No.: 15/692,953

(22) Filed: Aug. 31, 2017

(65) Prior Publication Data

US 2018/0229267 A1 Aug. 16, 2018

(30) Foreign Application Priority Data

Feb. 10, 2017 (JP) ..... JP2017-023274

(51) Int. Cl.

*H04R 17/00* (2006.01)
*B06B 1/02* (2006.01)
*B06B 1/06* (2006.01)

(52) U.S. Cl.

CPC ..... *B06B 1/0238* (2013.01); *B06B 1/0603* (2013.01); *B06B 1/0611* (2013.01); *B06B 1/0622* (2013.01); *B06B 1/0662* (2013.01)

(58) Field of Classification Search

CPC ..... B06B 1/0238
See application file for complete search history.

(56) References Cited

U.S. PATENT DOCUMENTS 4,703,213 A 10/1987 Gäsler
5,638,822 A * 6/1997 Seyed-Bolorforosh ..... B06B 1/0607 310/320

(Continued)

FOREIGN PATENT DOCUMENTS

EP 0 706 835 A1 4/1996
EP 2 381 271 A1 10/2011

(Continued)

OTHER PUBLICATIONS

Koji Ibata, et al., "An Air-Coupled Ultrasonic Sensor Applying a Bimorph Structure", The 2012 IEICE Society Conference, The Institute of Electronics; Information and Communication Engineers (IEICE), 2012. 3 Pages (Machine Generated English Translation).

*Primary Examiner* — Shawki S Ismail
*Assistant Examiner* — Karen B Addison
(74) *Attorney, Agent, or Firm* — Oblon, McClelland, Maier & Neustadt, L.L.P.

(57) ABSTRACT

According to one embodiment, a transducer includes a first electrode, a second electrode, a third electrode, a first piezoelectric portion, and a second piezoelectric portion. A resistor and an inductor are connected to the second electrode. The first piezoelectric portion is provided between the first electrode and the third electrode. The second piezoelectric portion is provided between the second electrode and the third electrode. A ratio of the absolute value of a difference between a first resonant frequency and a second resonant frequency to the first resonant frequency is 0.29 or less. The first resonant frequency is mechanical. The first resonant frequency is of the first piezoelectric portion and the second piezoelectric portion. The second resonant frequency is of a parallel resonant circuit. The parallel resonant circuit includes an electrostatic capacitance, the inductor, and the (Continued)

resistor. The electrostatic capacitance is between the second electrode and the third electrode.

15 Claims, 15 Drawing Sheets

(56) References Cited

U.S. PATENT DOCUMENTS

| | | | | |
|---|---|---|---|---|
| 5,757,104 | A | 5/1998 | Getman et al. | |
| 2005/0162040 | A1* | 7/2005 | Robert | H03H 9/173 310/322 |
| 2009/0001853 | A1 | 1/2009 | Adachi et al. | |
| 2010/0201222 | A1* | 8/2010 | Adachi | B06B 1/0622 310/317 |
| 2011/0261652 | A1 | 10/2011 | Horsky et al. | |
| 2015/0304780 | A1 | 10/2015 | Onishi | |
| 2016/0107194 | A1 | 4/2016 | Panchawagh et al. | |

FOREIGN PATENT DOCUMENTS

| | | | |
|---|---|---|---|
| EP | 2 928 208 | A1 | 10/2015 |
| JP | 3-79199 | A | 4/1991 |
| JP | 2961198 | | 10/1999 |
| WO | WO 2015/17122 | A1 | 11/2015 |
| WO | WO 2016/175013 | A1 | 11/2016 |

* cited by examiner

TRANSDUCER AND TRANSDUCER ARRAY

CROSS-REFERENCE TO RELATED APPLICATIONS

This application is based upon and claims the benefit of priority from Japanese Patent Application No. 2017-023274, filed on Feb. 10, 2017; the entire contents of which are incorporated herein by reference.

FIELD

Embodiments described herein relate generally to a transducer and a transducer array.

BACKGROUND

It is desirable to increase the bandwidth of a transducer using a piezoelectric body.

DETAILED DESCRIPTION

Figure 1:
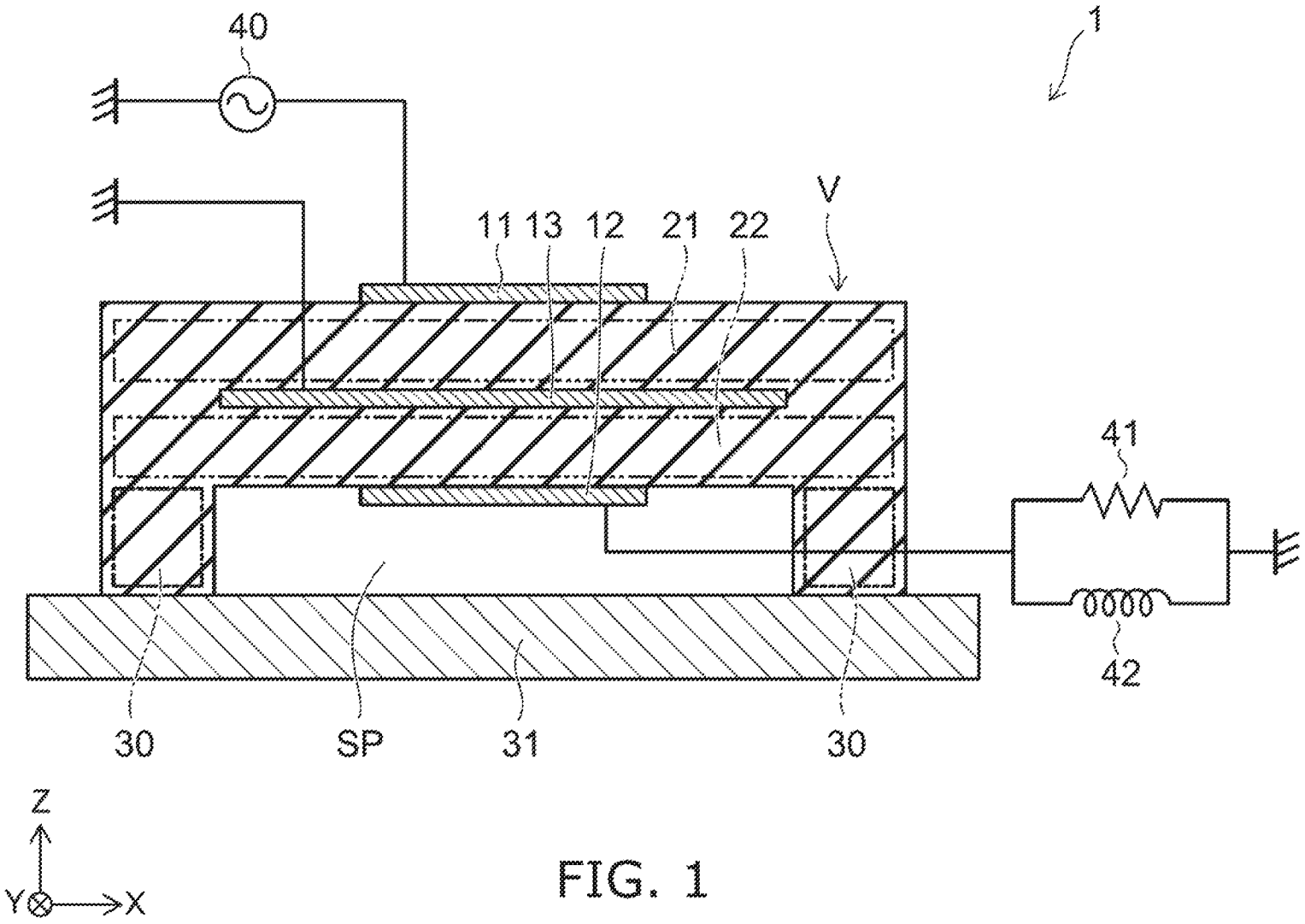
FIG. 1 is a cross-sectional view illustrating a transducer according to a first embodiment.

According to one embodiment, a transducer includes a first electrode, a second electrode, a third electrode, a first piezoelectric portion, and a second piezoelectric portion. A resistor and an inductor are connected to the second electrode. The third electrode is provided between the first electrode and the second electrode. The first piezoelectric portion is provided between the first electrode and the third electrode. The second piezoelectric portion is provided between the second electrode and the third electrode. A ratio of the absolute value of a difference between a first resonant frequency and a second resonant frequency to the first resonant frequency is 0.29 or less. The first resonant frequency is mechanical. The first resonant frequency is of the first piezoelectric portion and the second piezoelectric portion. The second resonant frequency is of a parallel resonant circuit. The parallel resonant circuit includes an electrostatic capacitance, the inductor, and the resistor. The electrostatic capacitance is between the second electrode and the third electrode.

Embodiments of the invention will now be described with reference to the drawings.

The drawings are schematic or conceptual; and the relationships between the thicknesses and widths of portions, the proportions of sizes between portions, etc., are not necessarily the same as the actual values thereof. The dimensions and/or the proportions may be illustrated differently between the drawings, even in the case where the same portion is illustrated.

In the drawings and the specification of the application, components similar to those described thereinabove are marked with like reference numerals, and a detailed description is omitted as appropriate.

First Embodiment

FIG. 1 is a cross-sectional view illustrating a transducer according to a first embodiment.

As Illustrated in FIG. 1, the transducer 1 according to the first embodiment includes a first electrode 11, a second electrode 12, a third electrode 13, a first piezoelectric portion 21, a second piezoelectric portion 22, a holder 30, a base body 31, a resistor 41, and an inductor 42.

The first electrode 11 and the second electrode 12 are separated in a first direction from the second electrode 12 toward the first electrode 11. The first direction is, for example, a Z-direction illustrated in FIG. 1. The third electrode 13 is provided between the first electrode 11 and the second electrode 12.

For example, the first electrode 11 is connected to a transmitting circuit 40 as illustrated in FIG. 1. The first electrode 11 may be connected to a receiving circuit instead of the transmitting circuit 40. The third electrode 13 is connected to ground. The resistor 41 and the inductor 42 are connected to the second electrode 12. The first piezoelectric portion 21 is provided between the first electrode 11 and the third electrode 13. The second piezoelectric portion 22 is provided between the second electrode 12 and the third electrode 13. The first electrode 11, the second electrode 12, the third electrode 13, the first piezoelectric portion 21, and the second piezoelectric portion 22 are included in a bending vibrator V.

The ratio of the absolute value of the difference between a first resonant frequency and a second resonant frequency to the first resonant frequency is set to be 0.29 or less; the first resonant frequency is mechanical and is of the first piezoelectric portion 21 and the second piezoelectric portion 22; the second resonant frequency is of a parallel resonant circuit including an electrostatic capacitance, the inductor 42, and the resistor 41; and the electrostatic capacitance is between the second electrode 12 and the third electrode 13.

According to the embodiment, the bandwidth of the transducer 1 can be widened.

The transducer 1 according to the first embodiment will now be described more specifically.

A portion of the first piezoelectric portion 21 does not overlap at least one of the first electrode 11 or the third electrode 13 in the first direction. A portion of the second piezoelectric portion 22 does not overlap at least one of the second electrode 12 or the third electrode 13 in the first direction. The first piezoelectric portion 21 and the second piezoelectric portion 22 may be formed as one body; and the third electrode 13 may be provided inside the first piezoelectric portion 21 and the second piezoelectric portion 22.

The outer edge of the second piezoelectric portion 22 overlaps the holder 30 in the first direction. For example, the holder 30 is provided along the outer edge of the second piezoelectric portion 22. Multiple holders 30 may be provided along the outer edge of the second piezoelectric portion 22. The holder 30 may be provided as one body with the second piezoelectric portion 22 or may be provided separately.

The holder 30 overlaps the base body 31 in the first direction. The holder 30 is positioned between the base body 31 and the second piezoelectric portion 22 in the first direction. The bending vibrator V is held by the base body 31 via the holder 30. The resistor 41 and the inductor 42 may be provided on the base body 31.

The second electrode 12 is positioned between the second piezoelectric portion 22 and the holder 30. A space SP is formed between the second electrode 12 and the base body 31. The second electrode 12, the second piezoelectric portion 22, the holder 30, and the base body 31 are provided around the space SP.

Figure 2:
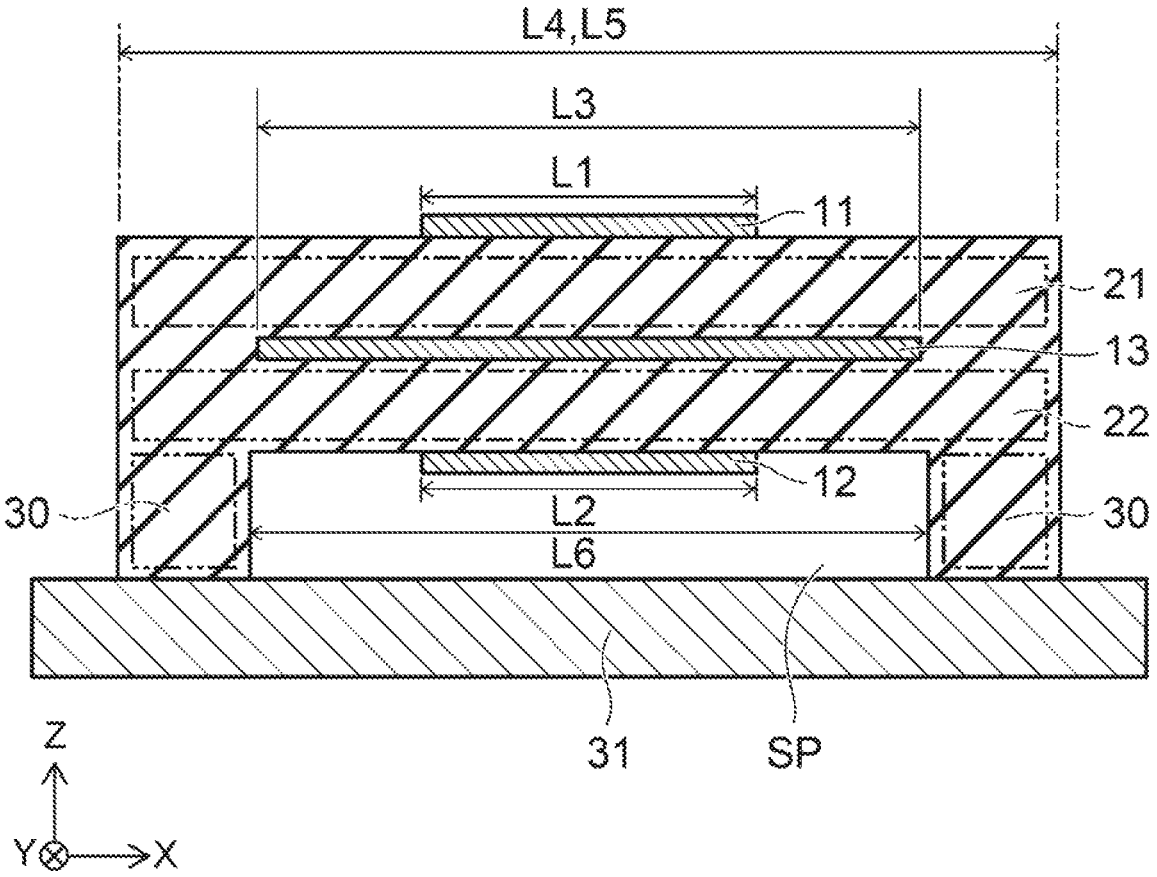
FIG. 2 is a cross-sectional view illustrating a portion of the transducer according to the first embodiment.

FIG. 2 is a cross-sectional view illustrating a portion of the transducer according to the first embodiment.

As illustrated in FIG. 2, at least one of a length L1 of the first electrode 11 in a second direction crossing the first direction, a length L2 of the second electrode 12 in the second direction, or a length L3 of the third electrode 13 in the second direction is not more than a length L4 of the first piezoelectric portion 21 in the second direction and not more than a length L5 of the second piezoelectric portion 22 in the second direction. In the example illustrated in FIG. 1, the length L3 is longer than the length L1 and longer than the length L2. In the example illustrated in FIG. 2, the length L4 and the length L5 are equal; but these lengths may be different. For example, a length L6 in the second direction of the space SP is longer than each of the length L1, the length L2, and the length L3. The length L6 also is the distance in the second direction between the holders 30.

The first electrode 11, the second electrode 12, and the third electrode 13 include, for example, metal materials such as copper, aluminum, nickel, etc. For example, the first piezoelectric portion 21, the second piezoelectric portion 22, and the holder 30 are formed as one body and include a piezoelectric material such as titanium oxide, barium oxide, etc. The first piezoelectric portion 21 and the second piezoelectric portion 22 have, for example, disc configurations. The base body 31 includes at least one of a metal material, a semiconductor material, or an insulating material. The configuration, material, etc., of the base body 31 are modifiable as appropriate as long as the base body 31 can hold the bending vibrator V. The base body 31 is, for example, a silicon substrate or a printed circuit board.

In the case where a sound wave is transmitted by the transducer 1, an alternating current voltage is applied to the first electrode 11 by the transmitting circuit 40. The transducer 1 vibrates due to the first piezoelectric portion 21 deforming according to the electric field between the first electrode 11 and the third electrode 13; and a sound wave is radiated in the Z-direction illustrated in FIG. 1.

In the case where a sound wave is received by the transducer 1, a voltage is generated between the first electrode 11 and the third electrode 13 by the transducer 1 vibrating due to the sound wave received by the transducer 1. The sound wave can be sensed by measuring the voltage by using a not-illustrated receiving circuit connected to the first electrode 11.

In particular, the transducer 1 is used favorably to transmit and receive an ultrasonic wave.

The second electrode 12 and the third electrode 13 overlap each other with the second piezoelectric portion 22 interposed in the first direction. Accordingly, an electrostatic capacitance exists between the second electrode 12 and the third electrode 13. In the transducer 1, the electrostatic capacitance, the resistor 41, and the inductor 42 are included in a parallel resonant circuit.

When the transducer 1 transmits the sound wave, the mechanical energy at the resonant frequency vicinity of the bending vibrator V is converted into electrical energy by the piezoelectric effect of the second piezoelectric portion 22. On the other hand, at the resonant frequency, the impedance and the resistance of the parallel resonant circuit are equal. Therefore, the parallel resonant circuit acts as a resistor at the resonant frequency vicinity of the bending vibrator V of the transducer 1. As a result, the electrical energy that is converted by the piezoelectric effect of the second piezoelectric portion 22 is consumed by the resistor 41. Accordingly, a loss of the mechanical energy of the vibration occurs; damping of the vibration occurs; and the bandwidth of the transducer 1 is widened.

The functions of the transducer according to the first embodiment will now be described more specifically while referring to a transducer according to a reference example.

Figure 3:
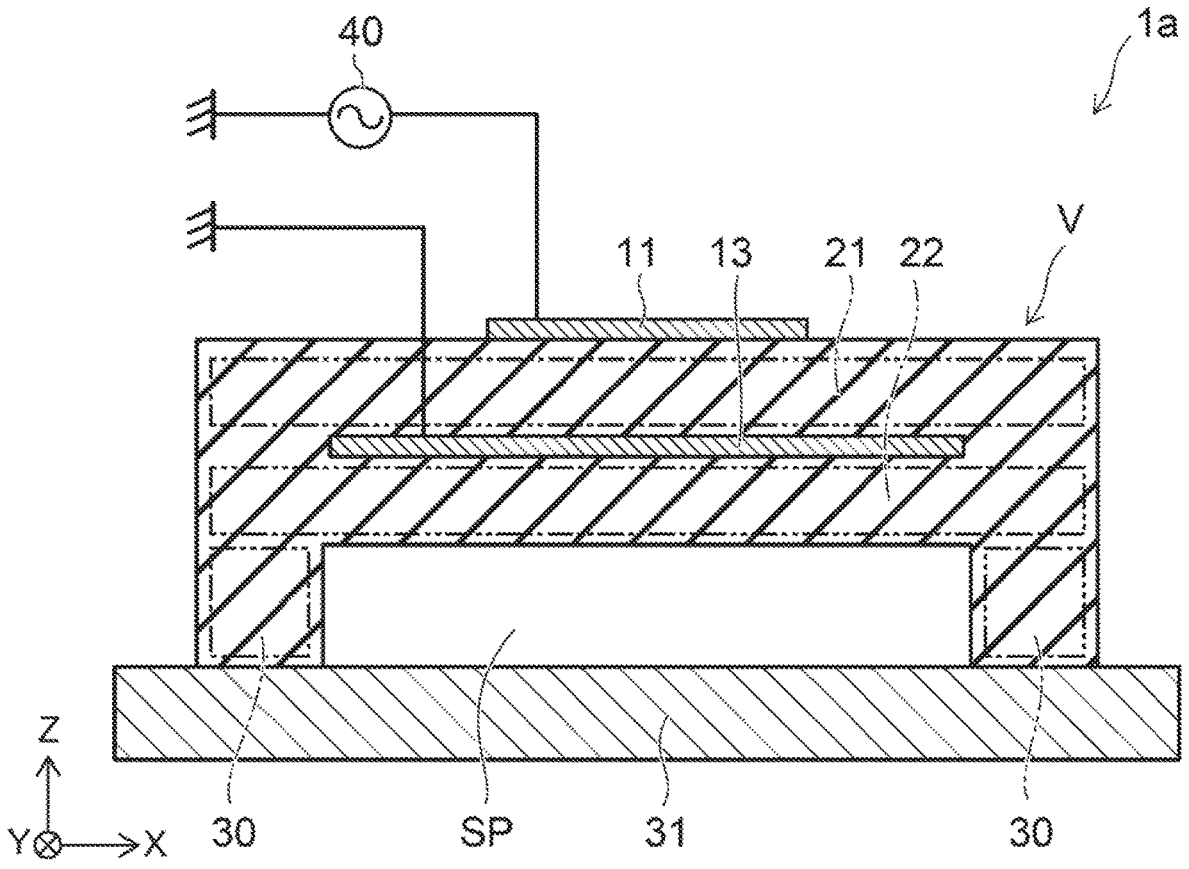
FIG. 3 is a cross-sectional view illustrating the transducer according to the reference example.

FIG. 3 is a cross-sectional view illustrating the transducer according to the reference example.

Figure 4A:
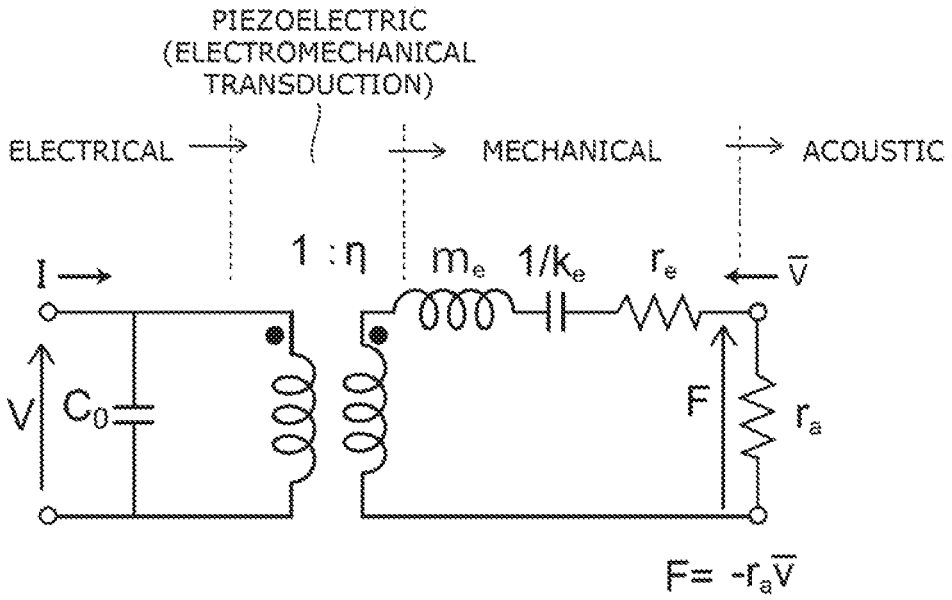
FIGS. 4A and 4B are equivalent circuits of a transducer according to a reference example.
Figure 4B:
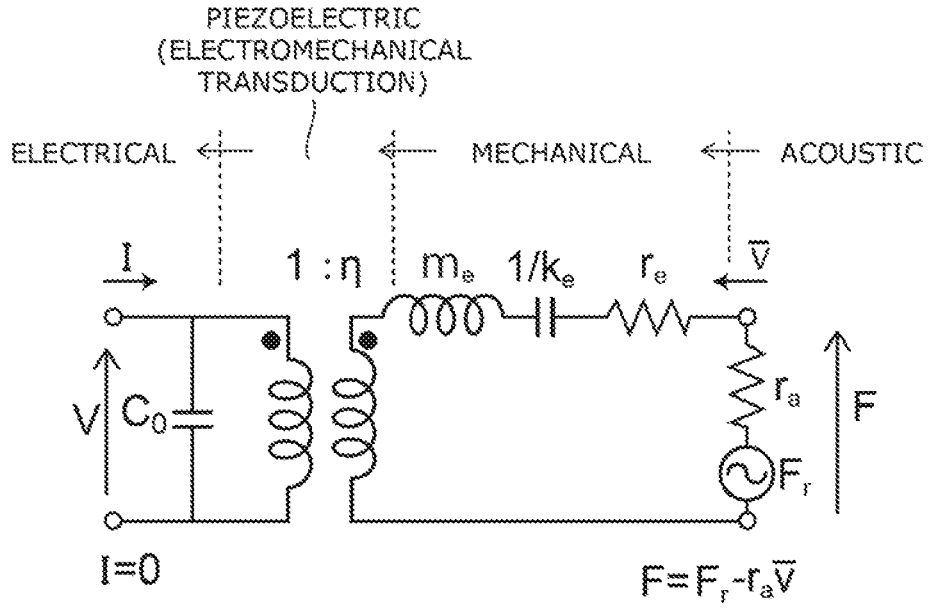

FIG. 4A is an equivalent circuit when the transducer according to the reference example is transmitting. FIG. 4B is an equivalent circuit when the transducer according to the reference example is receiving.

Figure 5A:
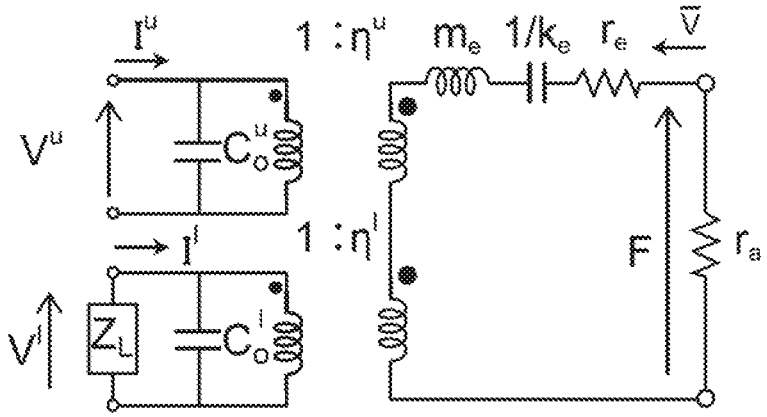
FIGS. 5A and 5B are equivalent circuits of the transducer according to the first embodiment.
Figure 5B:
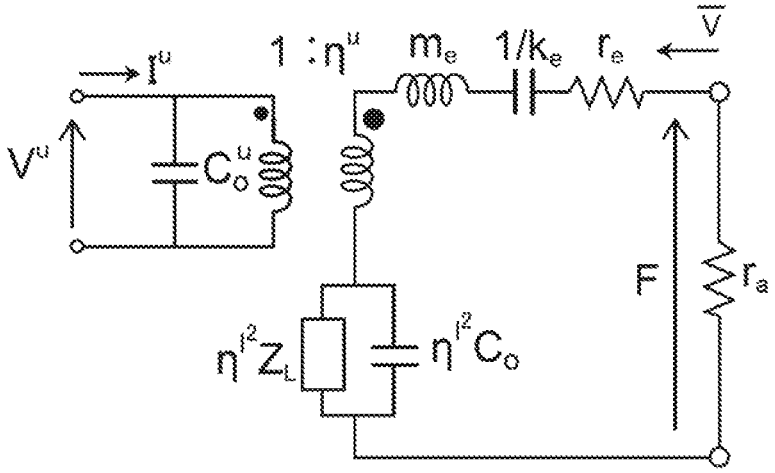

FIG. 5A is an equivalent circuit when the transducer according to the first embodiment is transmitting. FIG. 5B is an equivalent circuit when the transducer according to the first embodiment obtained by a modification of FIG. 5A is transmitting.

Compared to the transducer 1 according to the first embodiment, the transducer 1*a* according to the reference example illustrated in FIG. 3 does not include the second electrode 12, the resistor 41, and the inductor 42. In FIG. 4A, FIG. 4B, FIG. 5A, and FIG. 5B, V is the voltage; and I is the current. F and v respectively are a force and a velocity applied to a medium (e.g., air) by the bending vibrator V. $C_0$ is the electrostatic capacitance of the first piezoelectric portion 21 and the second piezoelectric portion 22. $m_e$, $k_e$, and $r_e$ respectively are the equivalent mass, the equivalent spring constant, and the equivalent damping constant of the bending vibrator V. $r_a$ is the acoustic load of air. $\eta$ is the turns ratio of the piezoelectric effect.

$F=P_t \cdot S$, where the transmission sound pressure is $P_t$, and the surface area of the bending vibrator V along a plane perpendicular to the first direction is S. The transmission sensitivity is represented by the following Formula (1), where the transmission voltage is $V_t$.

$$\frac{P_t}{V_t} = \frac{\eta}{S} \frac{j2\zeta_a(\omega/\omega_r)}{[1-(\omega/\omega_r)^2] + j2\zeta_{ea}(\omega/\omega_r)} \quad (1)$$

In Formula (1), $\omega$ is the angular frequency; and a is the resonance angular frequency. $\omega_r$ is represented by the following Formula (2).

$$\omega_r = \sqrt{\frac{k_e}{m_e}} \tag{2}$$

In Formula (1), $\zeta_a$ and $\zeta_{ea}$ are constants called damping ratios. $\zeta_a$ and $\zeta_{ea}$ are represented respectively by the following Formula (3) and Formula (4).

$$\zeta_a \frac{r_a}{2\sqrt{m_e k_e}} \tag{3}$$

$$\zeta_{ea} = \frac{r_e + r_a}{2\sqrt{m_e k_e}} \tag{4}$$

In the equivalent circuit when receiving illustrated in FIG. 4B, $F_r = P_r \cdot S$; and the reception sensitivity is represented by the following Formula (5), where the reception voltage is $V_r$ and the reception sound pressure is $P_r$ in the case of the open end (I=0).

$$\frac{V_r}{P_r} = \frac{\eta S}{k'_e C_0} \frac{1}{[1-(\omega/\omega_a)^2] + j2\zeta'_{ea}(\omega/\omega_a)} \tag{5}$$

$\omega_a$ is the antiresonant frequency. The following Formula (6) to Formula (8) hold for $k'_e$, $\omega_a$, and $\zeta'_{ea}$.

$$k'_e = k_e + \eta^2 / C_0 \tag{6}$$

$$\omega_a = \sqrt{\frac{k'_e}{m_e}} \tag{7}$$

$$\zeta'_{ea} = \frac{r_e + r_a}{2\sqrt{m_e k'_e}} \tag{8}$$

The transmission/reception sensitivity is obtained from the product of Formula (1) and Formula (5). Here, $\omega_a \approx \omega_r$ and $\zeta_{ea} \approx \zeta_{ea}$, where $k'_e \approx k_e$. In such a case, it can be seen that the profile (the bandwidth) of the frequency is determined by the damping ratio $\zeta_{ea}$ from Formula (1) and Formula (5).

Generally, a transducer that includes a bending vibrator using a piezoelectric body has a narrow bandwidth. This is because the acoustic load $r_a$ of the medium (e.g., air) is small; and the damping ratio $\zeta_{ea}$ is small.

In FIG. 5A and FIG. 5B, the values marked with the superscript character u relate to the first piezoelectric portion 21; and the values marked with the superscript character I relate to the second piezoelectric portion 22. $Z_L$ is the impedance of the parallel connection of an added inductance L and resistance R. The equivalent circuit of FIG. 5A can be modified to the equivalent circuit shown in FIG. 5B by moving the circuit element on the lower side of the electrical side to the circuit on the mechanical side.

Comparing the equivalent circuits of FIG. 5B and FIG. 4A, it can be seen that in the equivalent circuit of FIG. 5B, the parallel connection of the impedance $Z_L$ and a condenser having the capacitance $C_0$ are inserted into the mechanical side of the equivalent circuit of FIG. 4B, and the impedance is set to $f^{I2}$ times. The amount of the mechanical side set to $\eta^{I2}$ times is called the mechanical impedance.

Figure 6:
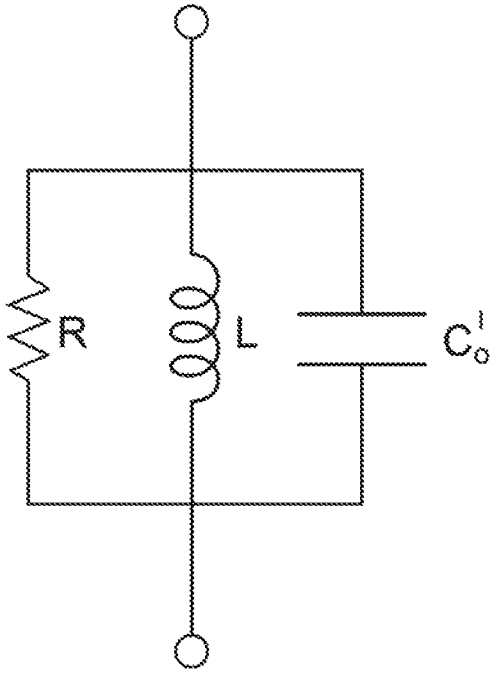
FIG. 6 is a circuit diagram illustrating an RLC parallel resonant circuit.

FIG. 6 is a circuit diagram illustrating an RLC parallel resonant circuit.

An impedance Z of the RLC parallel resonant circuit illustrated in FIG. 6 is represented by the following Formula (9).

$$Z = \frac{R}{1 + j(\omega C_0^I R - R/\omega L)} \tag{9}$$

The impedance Z of Formula (9) is Z=R at the resonance angular frequency represented by the following Formula (10).

$$\omega_0 = \frac{1}{\sqrt{LC_0^I}} \tag{10}$$

Accordingly, the impedance Z of the RLC parallel resonant circuit becomes R at the mechanical resonant frequency vicinity of the bending vibrator V by setting the inductance L so that $\omega_0$ matches $\omega_r$. Then, the corresponding mechanical impedance is $\eta^{I2} \cdot R$. This means that the damping ratio $\zeta_{ea}$ increases by the amount represented by the following Formula (11).

$$\zeta_R = \frac{\eta^{I2} R}{2\sqrt{m_e k_e}} \tag{11}$$

The transducer that is included in the bending vibrator V has a narrow bandwidth because the damping ratio $\zeta_{ea}$ is small. Formula (11) shows that widening the bandwidth is possible by increasing the damping ratio $\zeta_{ea}$. The bandwidth in which the RLC parallel resonant circuit operates as a resistor is represented by the following Formula (12).

$$\Delta\omega/\omega_0 \approx \frac{1}{\omega_0 C_0^I R} \tag{12}$$

As a result of investigations, the inventor discovered that in the case where $\omega_0$ is set to match $\omega_r$, the dependence on the bending vibrator V of the inductance L and the resistance R from Formula (10) and Formula (11) is represented by the following Formula (13) and Formula (14).

$$L \propto \frac{1}{\omega_r} \tag{13}$$

$$R \propto \zeta_R \tag{14}$$

In other words, if the value of the inductance L necessary for widening the bandwidth is dependent on only the resonant frequency of the bending vibrator V, for the same resonant frequency, the value of the inductance L necessary for widening the bandwidth is independent of the size of the bending vibrator V. The value of the resistance R necessary for widening the bandwidth is independent of the resonant frequency and is dependent on only the desired damping ratio. From these results and Formula (12), the bandwidth in which the RLC parallel resonant circuit acts as a resistor is represented by the following Formula (15).

$$\Delta\omega/\omega_r \propto \frac{1}{\zeta_R} \quad (15)$$

In other words, it was found that similarly to the resistance R, the bandwidth in which the RLC parallel resonant circuit acts as the resistor is independent of the resonant frequency and is dependent on only the desired damping ratio. From Formula (14) and Formula (15), it can be seen that the bandwidth $\Delta f/f_r$ in which the RLC parallel resonant circuit acts as the resistance R becomes narrow when a damping ratio $\zeta_R$ is increased and the resistance R is increased to widen the bandwidth. Accordingly, it can be seen that there is a desirable range for the resistance R.

In the case where the technical idea described above is applied to a typical piezoelectric air-coupled ultrasonic transducer, the inductance L and the resistance R are as follows. The frequency range of an ultrasonic wave in air is not less than 100 kilohertz (kHz) and not more than 1 megahertz (MHz). The inductance L is determined based on only the resonant frequency and is not less than 1.2 millihenries (mH) and not more than 12 mH.

Figure 7A:
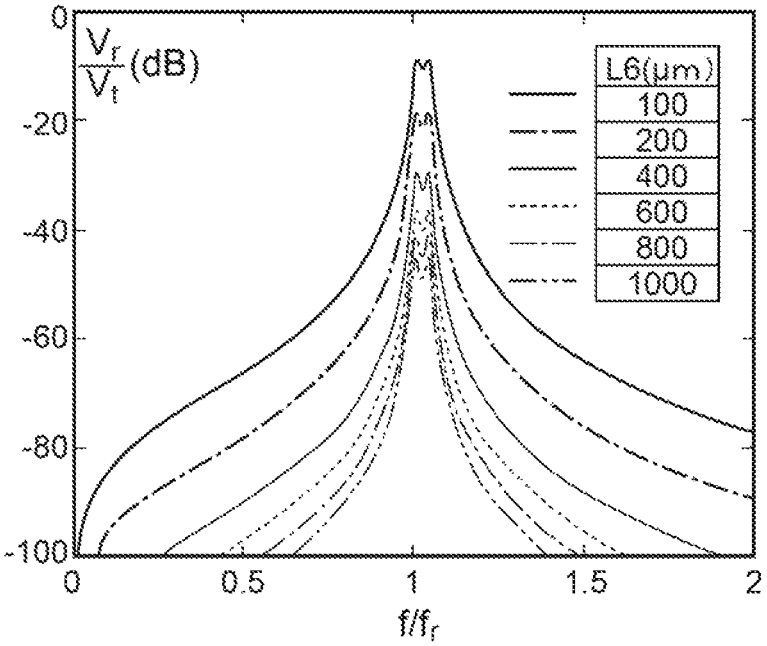
FIGS. 7A and 7B are graphs showing characteristics of the transducer according to the reference example.
Figure 7B:
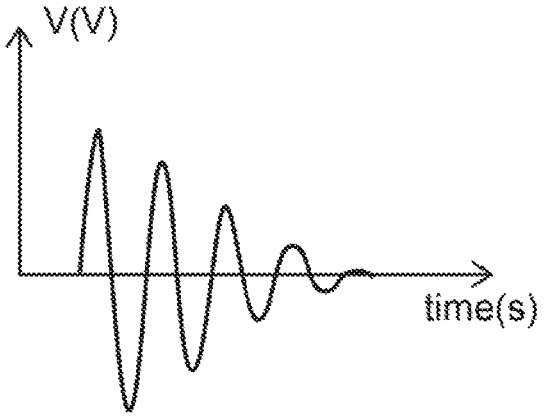

FIGS. 7A and 7B are graphs showing characteristics of the transducer according to the reference example.

Figure 8A:
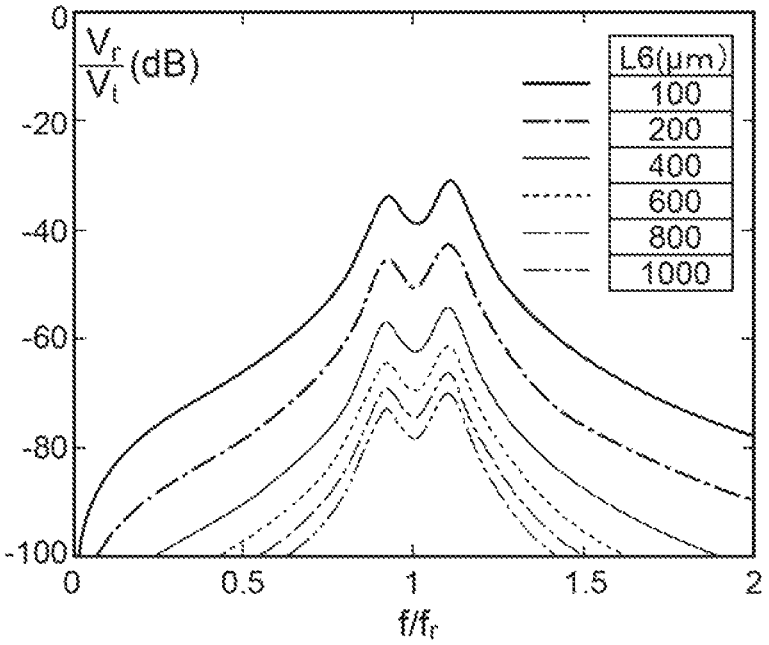
FIGS. 8A and 8B are graphs showing characteristics of the transducer according to the first embodiment.
Figure 8B:
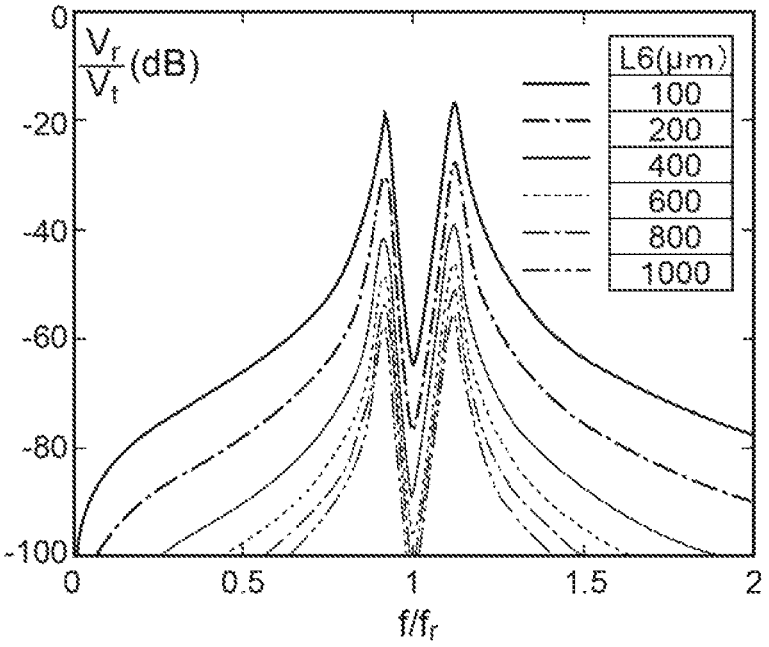

FIGS. 8A and 8B are graphs showing characteristics of the transducer according to the first embodiment.

FIG. 7A is simulation results illustrating the frequency characteristic of the transmission/reception sensitivity. FIG. 7B illustrates the voltage waveform when receiving the reflected wave of a sound wave transmitted by applying a pulse voltage.

FIG. 8A is simulation results illustrating the frequency characteristic of the transmission/reception sensitivity in the case where the damping ratio $\zeta_R$ is 0.1; and FIG. 8B is simulation results illustrating the frequency characteristic of the transmission/reception sensitivity in the case where the damping ratio $\zeta_R$ is 0.5. FIG. 7A, FIG. 8A, and FIG. 8B illustrate the results when the resonant frequency is set to 300 kHz and the length L6 illustrated in FIG. 2 is changed from 100 to 1000 μm.

In the transducer 1*a* according to the reference example as illustrated in FIG. 7A, the transmission/reception sensitivity at the resonant frequency is high; but the transmission/reception sensitivity decreases abruptly outside the resonant frequency. In the case where the transmission/reception of a sound wave is performed using a transducer having such a frequency profile, the pulse length lengthens as illustrated in FIG. 7B. When the pulse length lengthens, problems occur such as lower resolution in the distance direction, difficulty separating multiple reflections and signals, etc.

Comparing FIG. 7A and FIG. 8A, it can be seen that the bandwidth of the transducer 1 according to the embodiment is wider than that of the transducer 1*a* according to the reference example. On the other hand, as illustrated in FIG. 8B, it is undesirable that the frequency profile of the sensitivity is bimodal in the case where the damping ratio $\zeta_R$ is 0.5. The two peaks illustrated in FIG. 8B correspond to the resonant frequency and the antiresonant frequency described above.

Figure 9A:
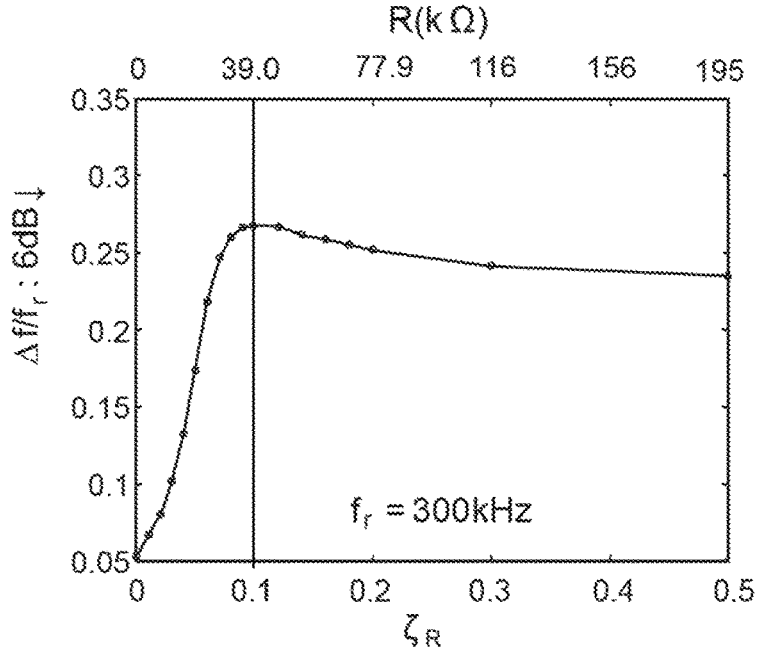
FIG. 9A, FIG. 9B, FIG. 9C, FIG. 10A, FIG. 10B, and FIG. 11 are graphs showing other characteristics of the transducer according to the first embodiment.
Figure 9B:
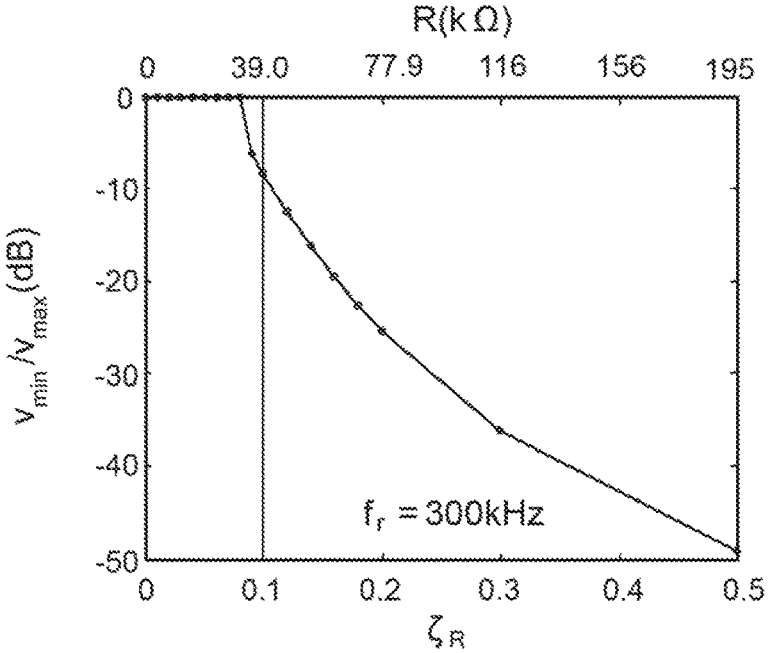

FIGS. 9A and 9B are graphs showing other characteristics of the transducer according to the first embodiment.

FIG. 9A shows the dependence of the bandwidth $\Delta f/f_r$ on the damping ratio $\zeta_R$ (the resistance R); and FIG. 9B shows the dependence of $V_{min}/V_{max}$ on the damping ratio $\zeta_R$ (the resistance R). $V_{min}/V_{max}$ illustrates the degree of the bimodality.

Figure 9C:
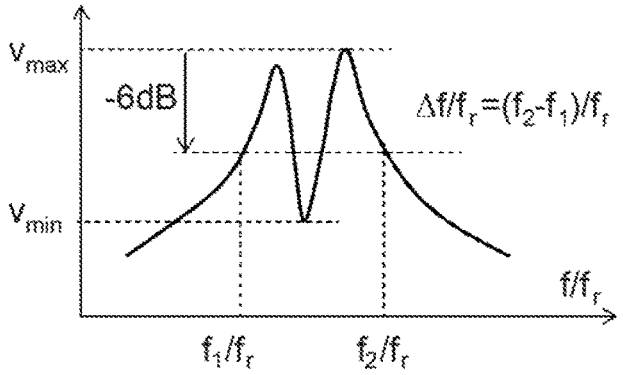

The definitions of the bandwidth $\Delta f/f_r$, $V_{min}$, and $V_{max}$ are shown in FIG. 9C. Namely, $V_{max}$ is the value of the higher of the two peaks; and $V_{min}$ is the value of the valley between the two peaks. $\Delta f/f_r$ Illustrates a bandwidth of −6 dB and is represented by $\Delta f/f_r=(f_2-f_1)/f_r$.

From FIG. 9A, it can be seen that the bandwidth $\Delta f/f_r$ widens as $\zeta_R$ increases, but decreases gradually when $\zeta_R$ exceeds 0.1. From FIG. 9B, it can be seen that the bimodality appears when $\zeta_R$ exceeds 0.08 and increases abruptly. It is difficult to widen the bandwidth when the bimodality is pronounced.

From FIG. 9A, when $\zeta_R$ is 0.04 or more, $\Delta f/f_r$ is not less than 2 times that when $\zeta_R$ is 0; and a pronounced effect is obtained. The resistance value R that corresponds to $\zeta_R=0.04$ is 16 kΩ. The optimal value is $\zeta_R=0.1$ when the bandwidth $\Delta f/f_r$ is a maximum and the bimodality is not pronounced. The resistance value R that corresponds to $\zeta_R=0.1$ is 39 kΩ. From these results, it can be seen that it is desirable for the resistance value R to be 39 kΩ or less. Although these figures illustrate the characteristics in the case where the resonant frequency is 300 kHz, this result is independent of the resonant frequency as described above.

Figure 10A:
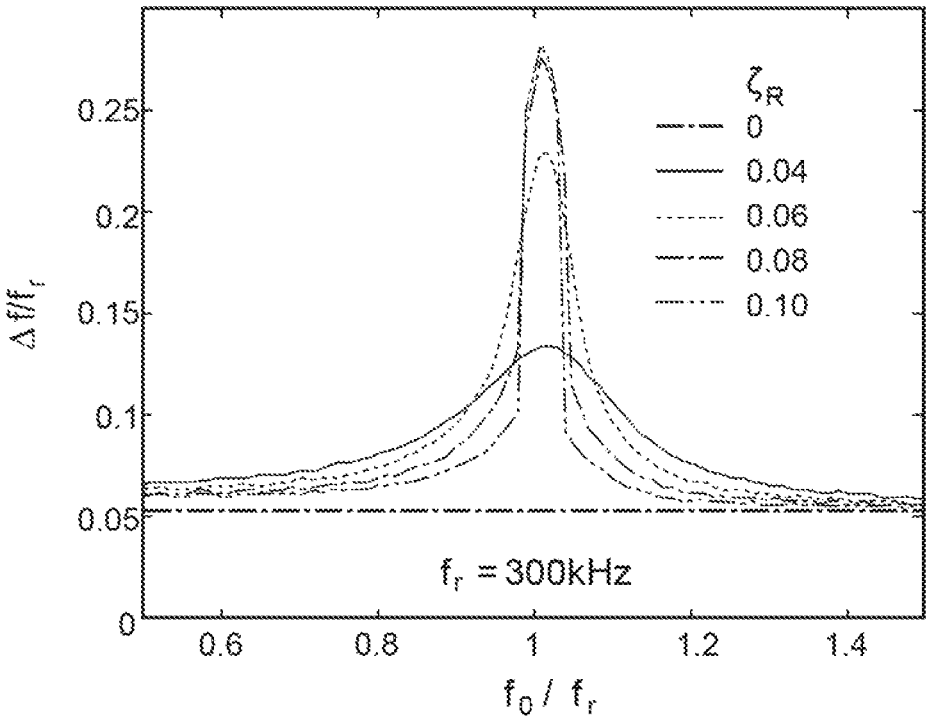
Figure 10B:
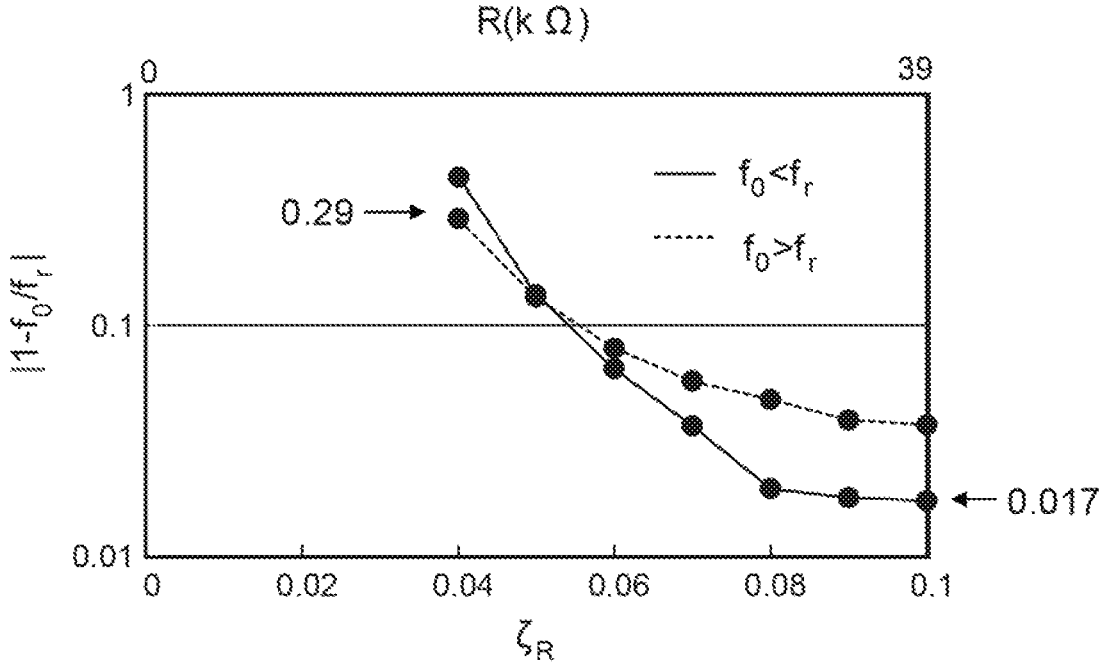

FIGS. 10A and 10B are graphs showing other characteristics of the transducer according to the first embodiment.

FIG. 8A, FIG. 8B, FIG. 9A, and FIG. 9B illustrate the characteristics in the case where a first resonant frequency $f_r$ of the bending vibrator V (the first piezoelectric portion 21 and the second piezoelectric portion 22) and a second resonant frequency $f_0$ of the RLC parallel resonant circuit match. The bandwidth $\Delta f/f_r$ in the case where $f_r$ and $f_0$ do not match is shown in FIG. 10A. As illustrated in FIG. 10A, the bandwidth decreases in the case where $f_r$ and $f_0$ do not match. Also, it can be seen that the decrease amount of the bandwidth increases as $\zeta_R$ increases.

FIG. 10B is a plot of $|1-f_0/f_r|$ which is ½(−6 dB) by the damping ratio $\zeta_R$ in the case where the bandwidth is $f_r=f_0$. In FIG. 10B, the solid line is the case where $f_0$ is smaller than $f_r$; and the broken line is the case where $f_0$ is larger than $f_r$. From FIG. 10B, it can be seen that for $\zeta_R=0.04$ which provides an effect not less than 2 times that of the transducer 1*a* according to the reference example, the decrease of the bandwidth is suppressed to ½ by setting the resonant frequency of the RLC parallel resonant circuit to be within 29% of the resonant frequency of the bending vibrator V. In other words, it is desirable for the ratio of the absolute value of the difference between the first resonant frequency $f_r$ and the second resonant frequency $f_0$ to the first resonant frequency $f_r$ to be 0.29 or less. It can be seen that for $\zeta_R=0.1$ where the highest bandwidth increase is possible, the decrease of the bandwidth is suppressed to ½ by setting the resonant frequency of the RLC parallel resonant circuit to be within 1.7% of the resonant frequency of the bending vibrator V. In other words, it is more desirable for the ratio of the absolute value of the difference between the first resonant frequency $f_r$ and the second resonant frequency $f_0$ to the first resonant frequency $f_r$ to be 0.017 or less. If the transducer is determined, the resonant frequency of the RLC parallel resonant circuit can be determined by the inductance L of the added coil.

Figure 11:
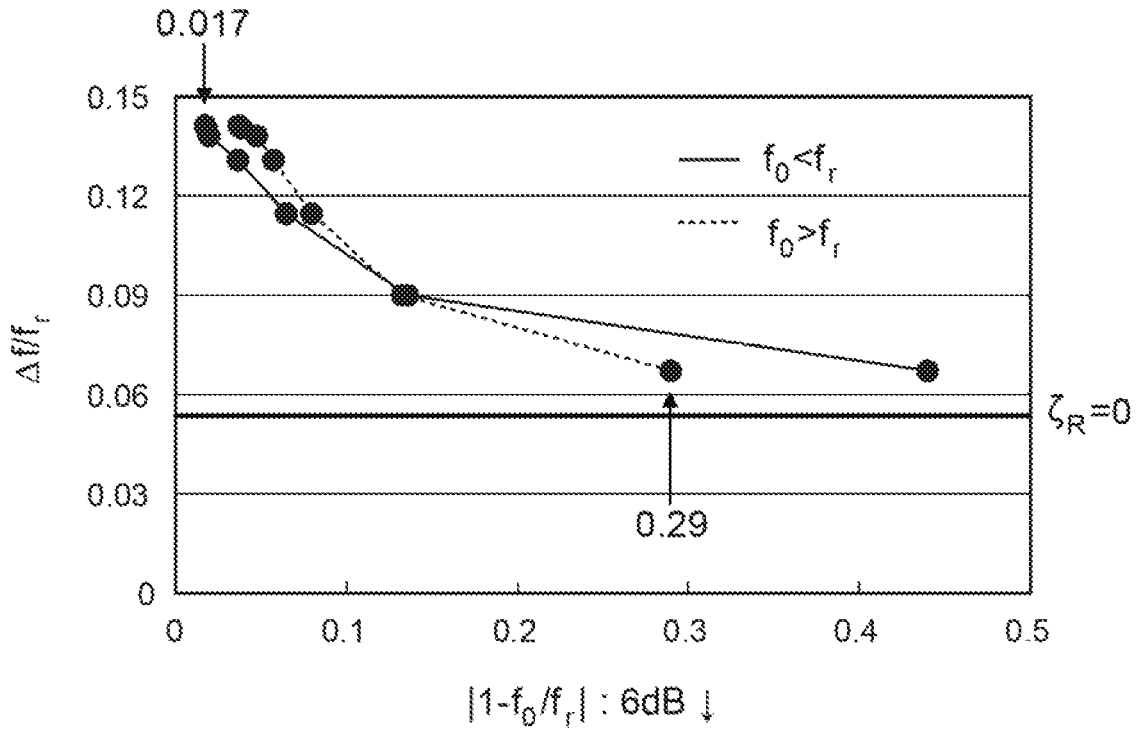

FIG. 11 is a graph showing other characteristics of the transducer according to the first embodiment.

FIG. 11 is a plot of the bandwidth $\Delta f/f_r$ by $|1-f_0/f_r|$ which is ½(−6 dB) in the case where the bandwidth is $f_r=f_0$ based on the data illustrated in FIG. 10A and FIG. 10B.

In FIG. 11, the solid line that extends in the lateral direction shows the data in the case where $\zeta_R=0$ (the transducer 1*a* according to the reference example).

From FIG. 11, it can be seen that the bandwidth $\Delta f/f_r$ increases as $|1-f_0/f_r|$ decreases. From FIG. 11, it can be seen that the bandwidth $\Delta f/f_r$ can be larger than that of the transducer 1*a* according to the reference example if $|1-f_0/f_r|$ is 0.29 or less. In other words, the bandwidth $\Delta f/f_r$ can be larger than that of the transducer 1*a* according to the reference example by setting the ratio of the absolute value of the difference between the first resonant frequency $f_r$ and the second resonant frequency $f_0$ to the first resonant frequency $f_r$ to be 0.29 or less.

As described above, according to the embodiment, the mechanical energy of the vibration is converted into electrical energy at the resonance point vicinity by the piezoelectric effects of the second piezoelectric portion 22 and the RLC parallel resonant circuit including the resistor 41, the inductor 42, and the capacitor between the second electrode 12 and the third electrode 13. Then, the electrical energy that is converted is consumed by the resistor 41; thereby, a loss of the mechanical energy of the vibration occurs; damping of the vibration occurs; and the transducer 1 having a wide bandwidth is realized.

As described above, the inventor discovered that more desirable characteristics are obtained for the transducer 1 when the resistance value of the resistor 41 is 39 kΩ or less, and the inductance of the inductor 42 is not less than 1.2 mH and not more than 12 mH.

Second Embodiment

Figure 12:
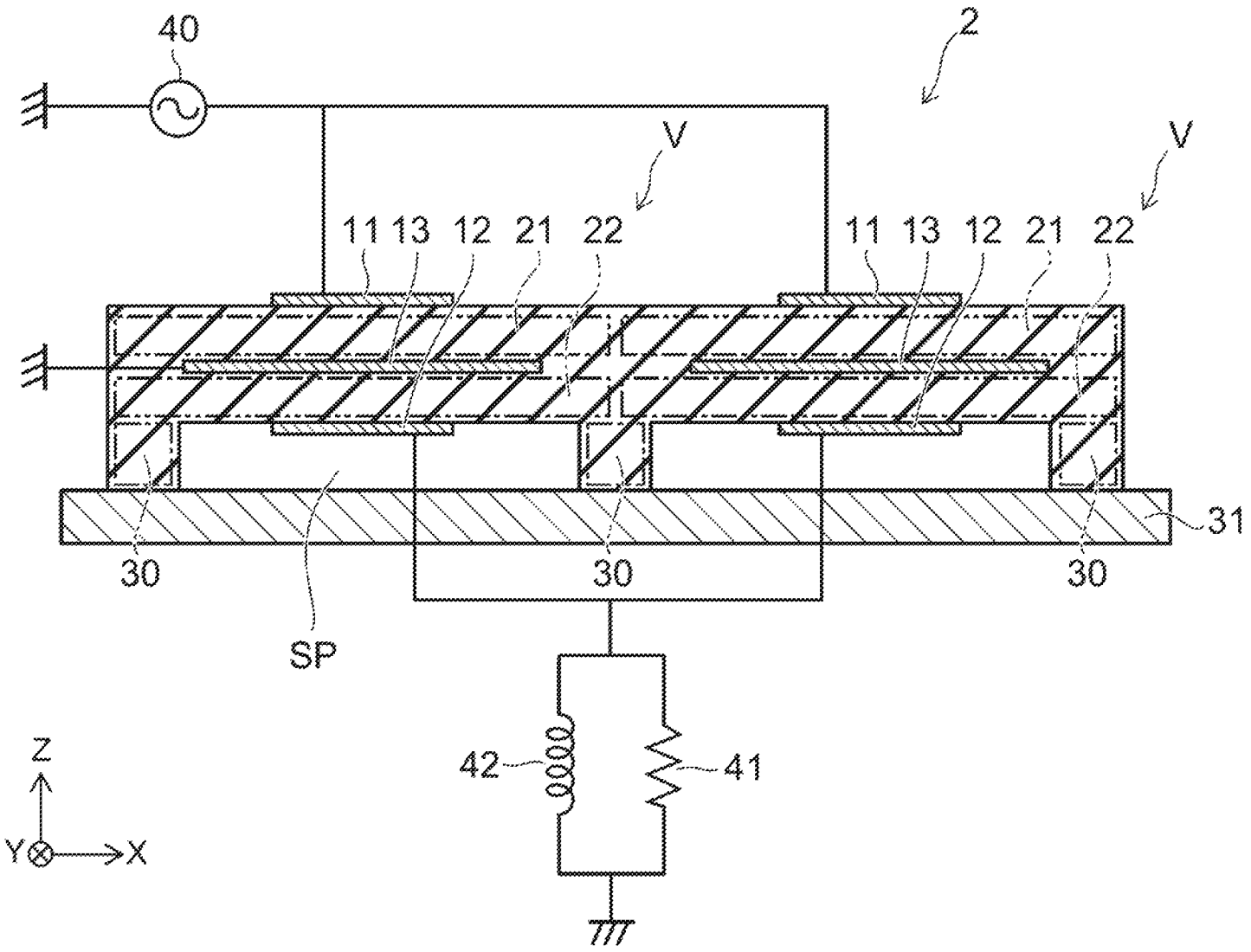
FIG. 12 is a cross-sectional view illustrating a transducer array according to a second embodiment.

FIG. 12 is a cross-sectional view illustrating a transducer array according to a second embodiment.

As illustrated in FIG. 12, the transducer array 2 (which may be called the "transducer") includes the multiple first electrodes 11, the multiple second electrodes 12, the multiple third electrodes 13, the multiple first piezoelectric portions 21, the multiple second piezoelectric portions 22, the holder 30, the resistor 41, and the inductor 42. In other words, the transducer array 2 includes the multiple transducers 1.

The first electrode 11, the second electrode 12, the third electrode 13, the first piezoelectric portion 21, and the second piezoelectric portion 22 each are multiply provided in the second direction crossing the first direction. The first electrode 11, the second electrode 12, and the third electrode 13 each may be multiply provided further in a third direction. The third direction crosses the first direction and the second direction and is, for example, a Y-direction illustrated in FIG. 12.

The multiple first piezoelectric portions 21 are provided respectively between the multiple first electrodes 11 and the multiple third electrodes 13 in the first direction. The multiple second piezoelectric portions 22 are provided respectively between the multiple second electrodes 12 and the multiple third electrodes 13 in the first direction. The multiple first piezoelectric portions 21 and the multiple second piezoelectric portions 22 may be provided as one body or may be provided individually. The resistor 41 and the inductor 42 are connected to the multiple second electrodes 12. The transmitting circuit 40 or a not-illustrated receiving circuit is connected to the multiple first electrodes 11.

Here, for the transducer 1 according to the first embodiment illustrated in FIG. 1, R is the resistance value of the resistor 41, and L is the inductance of the inductor 42; and for the transducer array 2 according to the second embodiment illustrated in FIG. 12, R' is the resistance value of the resistor 41, and L' is the inductance of the inductor 42. The bending vibrators V that are included in the transducer array 2 are caused to operate at conditions similar to those of the bending vibrator V included in the transducer 1 according to the first embodiment by setting L'=L/2 and R'=R/2.

Similarly, in the case where N bending vibrators are electrically connected in parallel, the values of the necessary inductance and resistance are 1/N times those of the first embodiment. For example, the value of the necessary inductance L is 4 mH in the case where the resonant frequency of the transducer is 300 kHz, the size of the transducer is 3 mm×3 mm, and the transducer includes one bending vibrator V having a diameter of 3 mm. On the other hand, in the case where the diameter of the bending vibrator V is 0.5 mm, the transducer can hold thirty-six bending vibrators. In such a case, the value of the necessary inductance L is 110 μH.

An inductor that has a mH-order inductance is large and expensive, and may cause a larger size and a higher cost of the circuit board. However, an inductor that has a μH-order inductance is small and inexpensive; therefore, a smaller size and a lower cost of the circuit board are possible. Accordingly, it is desirable to configuration the transducer using the multiple bending vibrators V.

Third Embodiment

Figure 13:
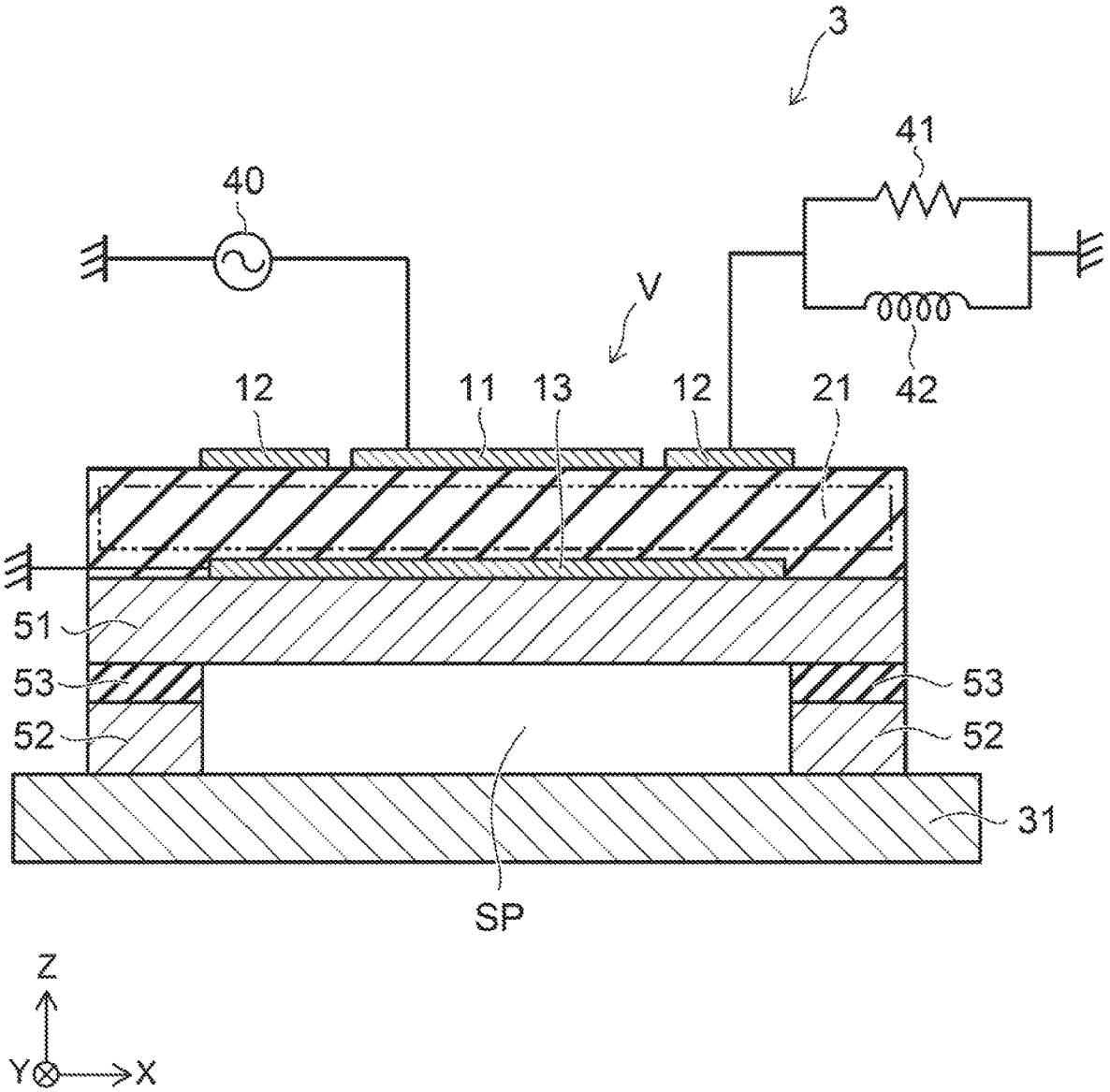
FIG. 13 is a cross-sectional view illustrating a transducer according to a third embodiment.

FIG. 13 is a cross-sectional view illustrating a transducer according to a third embodiment.

As illustrated in FIG. 13, the transducer 3 includes the first electrode 11, the second electrode 12, the third electrode 13, the first piezoelectric portion 21, the holder 30, the resistor 41, the inductor 42, a first semiconductor portion 51, a second semiconductor portion 52, and an insulating portion 53.

The second electrode 12 is separated from the first electrode 11 in the second direction and the third direction. The second electrode 12 is provided around the first electrode 11 along the second direction and the third direction. The third electrode 13 is separated from the first electrode 11 and the second electrode 12 in the first direction. The first piezoelectric portion 21 is provided between the first electrode 11 and the third electrode 13 and between the second electrode 12 and the third electrode 13 in the first direction.

The first semiconductor portion 51 and the second semiconductor portion 52 include semiconductor materials such as silicon, etc. The insulating portion 53 includes an insulating material such as silicon oxide, etc. Another member that is elastic may be provided instead of the first semiconductor portion 51. Another member that holds the outer edge of the first semiconductor portion 51 may be provided instead of the second semiconductor portion 52 and the insulating portion 53.

In the transducer 3, the first electrode 11, the third electrode 13, and the first piezoelectric portion 21 between these electrodes perform the transmission/reception of the sound waves; and the second electrode 12, the third electrode 13, and the first piezoelectric portion 21 between these electrodes perform the damping of the vibration.

The transducer 3 according to the embodiment may be formed without stacking multiple piezoelectric portions as in the transducer 1 according to the first embodiment. For example, the transducer 3 according to the embodiment is made using piezoelectric thin film formation technology and MEMS technology. Such a structure is called a pMUT (piezoelectric micro-machined ultrasonic transducer). In the case where the transducer 3 is made using an SOI substrate, the first semiconductor portion 51 is a Si layer; the second semiconductor portion 52 is a Si substrate; and the insulating portion 53 is a silicon oxide layer. The space SP is formed by reactive ion etching of the Si substrate.

Fourth Embodiment

Figure 14:
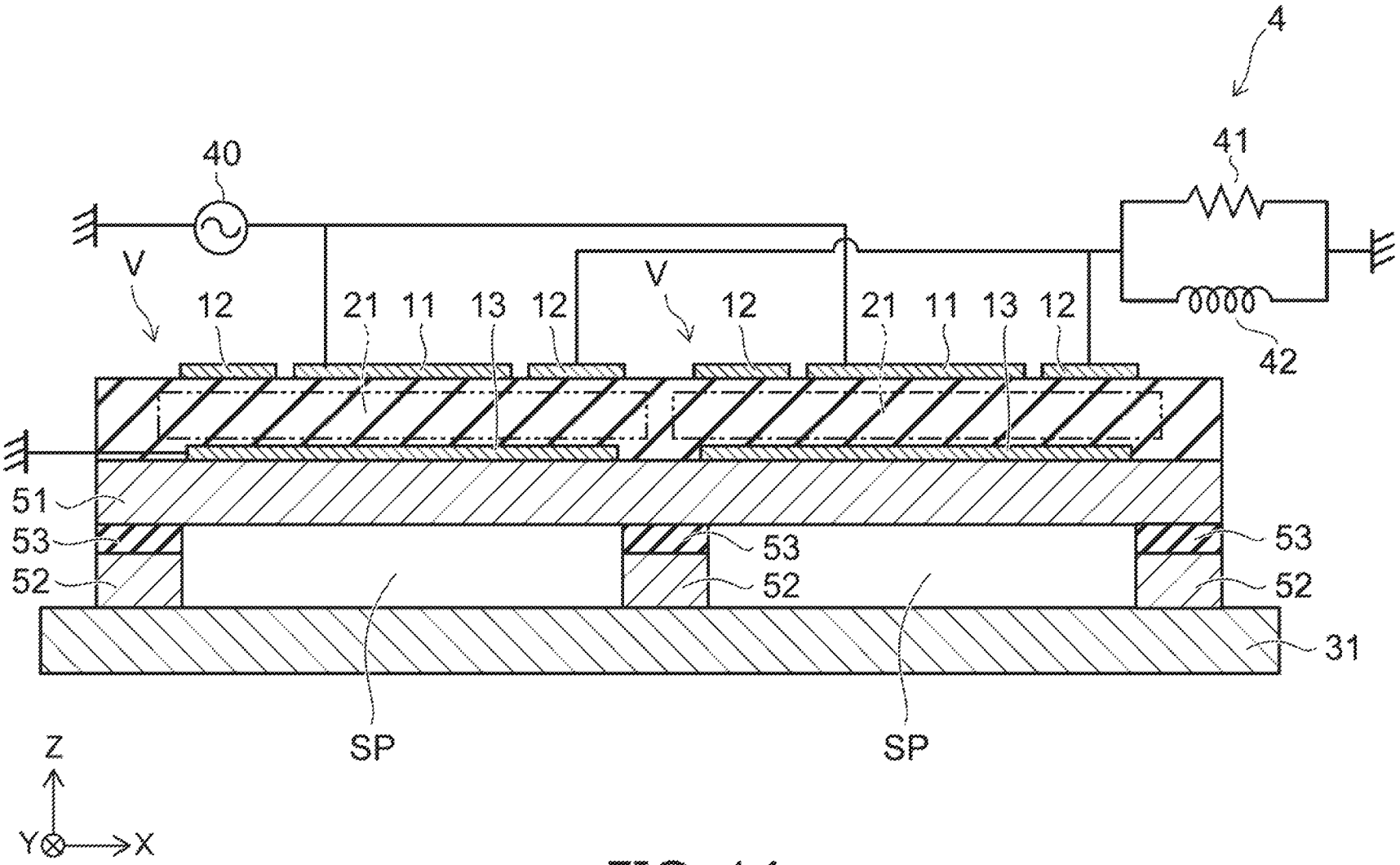
FIG. 14 is a cross-sectional view illustrating a transducer array according to a fourth embodiment.

FIG. 14 is a cross-sectional view illustrating a transducer array according to a fourth embodiment.

As illustrated in FIG. 14, the transducer array 4 includes the multiple first electrodes 11, the multiple second electrodes 12, the multiple third electrodes 13, the first piezoelectric portion 21, the resistor 41, the inductor 42, the first semiconductor portion 51, the second semiconductor portion 52, and the insulating portion 53. In other words, the transducer array 4 includes multiple transducers 3.

The first electrode 11, the second electrode 12, and the third electrode 13 each are multiply provided in the second direction crossing the first direction. Further, the first electrode 11, the second electrode 12, and the third electrode 13 each may be multiply provided in the third direction. The multiple second electrodes 12 are provided respectively around the multiple first electrodes 11 along the second direction and the third direction. The multiple first piezoelectric portions 21 are provided between the multiple first electrodes 11 and the multiple third electrodes 13 and between the multiple second electrodes 12 and the multiple third electrodes 13 in the first direction. The resistor 41 and the inductor 42 are connected to the multiple second electrodes 12. The transmitting circuit 40 or a not-illustrated receiving circuit is connected to the multiple first electrodes 11.

According to the embodiment, similarly to the second embodiment, the inductance of the inductor 42 necessary to obtain the desired characteristics can be reduced.

Fifth Embodiment

Figure 15A:
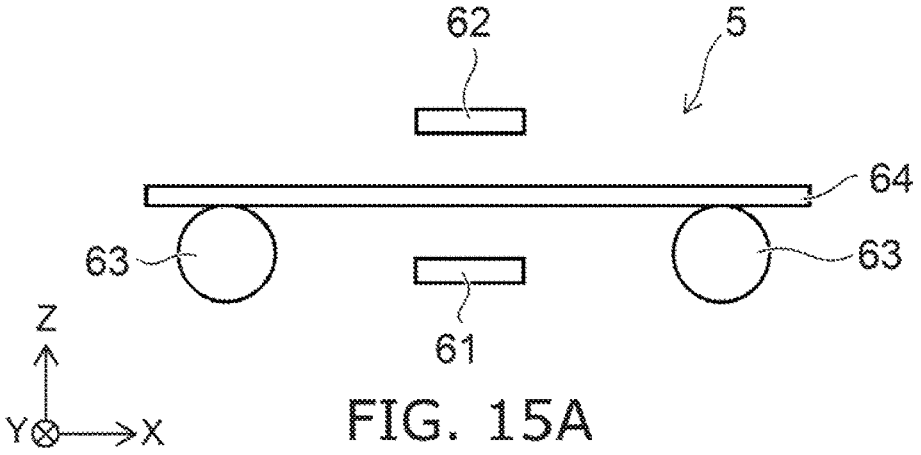
FIGS. 15A to 15C are schematic views illustrating an inspection apparatus according to a fifth embodiment.
Figure 15B:
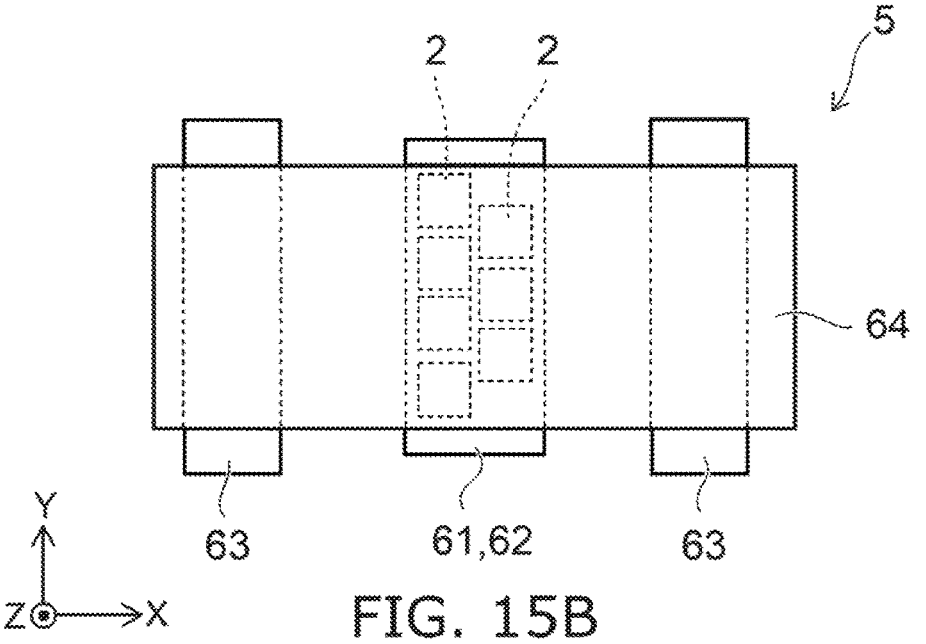
Figure 15C:
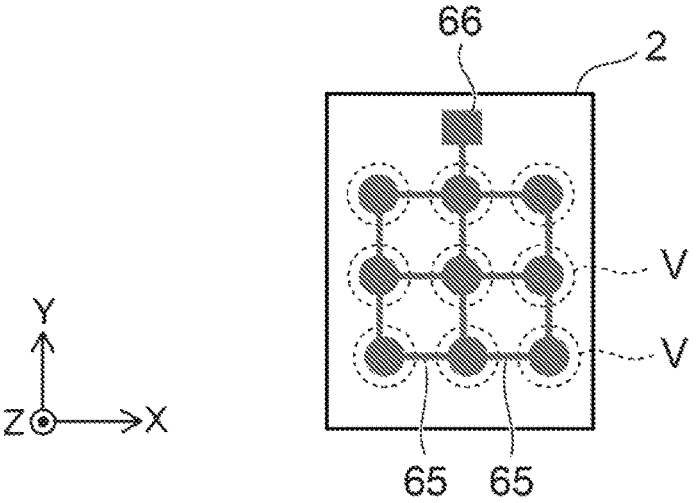

FIG. 15A is a cross-sectional view illustrating an inspection apparatus according to a fifth embodiment. FIG. 15B is a plan view illustrating the inspection apparatus according to the fifth embodiment. FIG. 15C is a plan view of an enlargement of the transducer array included in the inspection apparatus according to the fifth embodiment.

The inspection apparatus 5 according to the embodiment includes a transmitter module 61, a receiver module 62, and rollers 63 as illustrated in FIG. 15A and FIG. 15B. For example, the inspection apparatus 5 is used to inspect a paper sheet or the like, and uses an ultrasonic wave to inspect the thickness of paper 64 conveyed by the rollers 63.

The transmitter module 61 and the receiver module 62 are separated in the first direction. The rollers 63 convey the paper 64 in the second direction so that the paper 64 passes between the transmitter module 61 and the receiver module 62. An ultrasonic wave is radiated from the transmitter module 61 toward the receiver module 62 when a voltage is applied to the transmitter module 61. The ultrasonic wave that is radiated passes through the paper and is received by the receiver module 62. As the thickness of the paper 64 increases, the attenuation of the ultrasonic wave when passing through the paper 64 increases; and the intensity of the received signal at the receiver module 62 decreases. Accordingly, the thickness of the paper 64 can be confirmed based on the intensity of the received signal.

As illustrated in FIG. 15A and FIG. 15C, the transmitter module 61 and the receiver module 62 include, for example, multiple transducer arrays 2. A transducer or a transducer array according to another embodiment may be provided instead of the transducer array 2. By providing the multiple transducer arrays 2 in the transmitter module 61 and the receiver module 62, the distribution of the thickness of the paper 64 in the second direction and the third direction also can be inspected.

As illustrated in FIG. 15C, the transducer array 2 includes multiple bending vibrators V arranged in the second direction and the third direction. An auxiliary electrode 65 is provided between the bending vibrators V. One of the multiple first electrodes 11 or the multiple second electrodes 12 included in the transducer array 2 is connected to one of a transmitting circuit, a receiving circuit, or an RL parallel resonant circuit via the auxiliary electrode 65 and a contact electrode 66. The other of the multiple first electrodes 11 or the multiple second electrodes 12 is connected to another one of the transmitting circuit, the receiving circuit, or the RL parallel resonant circuit via a not-illustrated electrode.

Here, the distribution of the thickness of the paper 64 is inspected using a feed velocity v of the paper 64, and a spacing $\delta x$ along the feed direction of the paper 64. In such a case, it is necessary to perform the transmission and reception of the ultrasonic pulse in a time interval of $\delta t = \delta x / v$. The time interval $\delta t$ decreases as the measurement interval $\delta x$ decreases. Therefore, in the case where the transducer array 2 has a narrow bandwidth and the pulse length is long, the pulse is not settled within the interval $\delta t$. Accordingly, to reduce the measurement interval $\delta x$, it is desirable to use a transducer having a wide bandwidth and a shorter pulse length. In other words, it is possible to increase the inspection speed by the inspection apparatus 5 including the transducers or the transducer arrays according to the embodiments.

According to the embodiments described above, it is possible to increase the bandwidth of a transducer and a transducer array.

In the specification of the application, "perpendicular" and "parallel" refer to not only strictly perpendicular and strictly parallel but also include, for example, the fluctuation due to manufacturing processes, etc. It is sufficient to be substantially perpendicular and substantially parallel.

Hereinabove, embodiments of the invention are described with reference to specific examples. However, the invention is not limited to these specific examples. For example, one skilled in the art may similarly practice the invention by appropriately selecting specific configurations of components included in the transducer such as the first electrode 11, the second electrode 12, the third electrode 13, the first piezoelectric portion 21, the second piezoelectric portion 22, the holder 30, the base body 31, the transmitting circuit 40, the resistor 41, the inductor 42, the first semiconductor portion 51, the second semiconductor portion 52, the insulating portion 53, etc., from known art; and such practice is within the scope of the invention to the extent that similar effects can be obtained.

Further, any two or more components of the specific examples may be combined within the extent of technical feasibility and are included in the scope of the invention to the extent that the purport of the invention is included.

Moreover, all transducers and transducer arrays practicable by an appropriate design modification by one skilled in the art based on the transducers and the transducer arrays described above as embodiments of the invention also are within the scope of the invention to the extent that the spirit of the invention is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A transducer, comprising:

a first electrode;

a second electrode, a resistor and an inductor being connected to the second electrode;

a third electrode provided between the first electrode and the second electrode;

a first piezoelectric portion provided between the first electrode and the third electrode; and a second piezoelectric portion provided between the second electrode and the third electrode, a ratio of the absolute value of a difference between a first resonant frequency and a second resonant frequency to the first resonant frequency being 0.29 or less, the first resonant frequency being mechanical and being of the first piezoelectric portion and the second piezoelectric portion, the second resonant frequency being of a parallel resonant circuit, the parallel resonant circuit including an electrostatic capacitance, the inductor, and the resistor, the electrostatic capacitance being between the second electrode and the third electrode.

2. The transducer according to claim 1, wherein a portion of the first piezoelectric portion does not overlap at least one of the first electrode or the second electrode in a first direction, the first direction being from the first electrode toward the second electrode.

3. The transducer according to claim 2, wherein a length of the third electrode in a second direction crossing the first direction is longer than a length of the first electrode in the second direction.

4. The transducer according to claim 3, wherein the length of the third electrode in the second direction is longer than a length of the second electrode in the second direction.

5. The transducer according to claim 1, wherein a portion of the second piezoelectric portion does not overlap the third electrode in a first direction, the first direction being from the first electrode toward the second electrode.

6. The transducer according to claim 1, wherein the ratio of the absolute value of the difference between the first resonant frequency and the second resonant frequency to the first resonant frequency is 0.017 or less.

7. The transducer according to claim 1, wherein the inductor is not less than 1.2 millihenries and not more than 12 millihenries, and the resistor is 39 kilo-ohms or less.

8. A transducer array, comprising N of a plurality of transducers according to claim 1, an inductor and a resistor of one of the plurality of transducers being connected to a plurality of the second electrodes of the plurality of transducers, the inductor and the resistor of the one of the plurality of transducers being common to the plurality of the second electrodes, an inductance of the inductor being not less than 1.2/N millihenries and not more than 12/N millihenries, a resistance value of the resistor being 39/N kilo-ohms or less.

9. A transducer, comprising:

a first electrode;

a second electrode separated from the first electrode in a second direction, a resistor and an inductor being connected to the second electrode;

a third electrode separated from the first electrode and the second electrode in a first direction crossing the second direction; and a first piezoelectric portion provided between the first electrode and the third electrode and between the second electrode and the third electrode in the first direction, a ratio of the absolute value of a difference between a first resonant frequency and a second resonant frequency to the first resonant frequency being 0.29 or less, the first resonant frequency being mechanical and being of the first piezoelectric portion and the second piezoelectric portion, the second resonant frequency being of a parallel resonant circuit, the parallel resonant circuit including an electrostatic capacitance, the inductor, and the resistor, the electrostatic capacitance being between the second electrode and the third electrode.

10. The transducer according to claim 9, wherein the second electrode is provided around the first electrode along the second direction and a third direction, the third direction crossing the first direction and the second direction.

11. The transducer according to claim 9, further comprising a first semiconductor portion, the third electrode being provided between the first piezoelectric portion and the first semiconductor portion in the first direction.

12. The transducer according to claim 11, further comprising:

a first insulating portion overlapping an outer perimeter of the first semiconductor portion in the first direction; and a second semiconductor portion overlapping the first insulating portion in the first direction.

13. The transducer according to claim 12, wherein the first semiconductor portion and the second semiconductor portion include silicon, and the first insulating portion includes silicon oxide.

14. The transducer according to claim 9, wherein the ratio of the absolute value of the difference between the first resonant frequency and the second resonant frequency to the first resonant frequency is 0.017 or less.

15. The transducer according to claim 9, wherein the inductor is not less than 1.2 millihenries and not more than 12 millihenries, and the resistor is 39 kilo-ohms or less.

* * * * *